US006186820B1

(12) United States Patent
Daoud

(10) Patent No.: US 6,186,820 B1
(45) Date of Patent: Feb. 13, 2001

(54) WIRE-WRAP CONNECTOR BLOCK BASE HAVING AN ARTICULABLE SIDE WALL

(75) Inventor: Bassel Hage Daoud, Parsippany, NJ (US)

(73) Assignee: Lucent Technologies, Inc., Murray Hill, NJ (US)

( * ) Notice: Under 35 U.S.C. 154(b), the term of this patent shall be extended for 0 days.

(21) Appl. No.: 09/340,833

(22) Filed: Jun. 28, 1999

(51) Int. Cl.[7] ..... H01R 4/24

(52) U.S. Cl. ..... 439/404; 439/276; 439/467; 439/888; 439/936

(58) Field of Search ..... 439/404, 409, 439/417, 276, 467, 596, 521, 936, 888; 379/451

(56) References Cited

U.S. PATENT DOCUMENTS 5,256,072 * 10/1993 Hatagishi ..... 439/79
5,967,829 * 10/1999 Shinchi ..... 439/467
6,030,252 * 2/2000 Oda et al. ..... 439/936

* cited by examiner

*Primary Examiner*—Paula Bradley
*Assistant Examiner*—Tho D. Ta
(74) *Attorney, Agent, or Firm*—Stroock & Stroock & Lavan LLP

(57) ABSTRACT

A wire-wrap connector block having a base that includes an articulable wall section that facilitates both automated wire-wrapping and potting procedures. During the wire-wrap procedure, the articulable wall section is latched in a position that permits the wire-wrap equipment to access the wire-wrap terminals without undesirable vertical movement of the wire-wrap equipment and wire. During the potting procedure, the articulable wall section is latched in a position in which the articulable wall section, together with another, non-articulable wall section, creates a substantially continuous wall about the bottom surface of the wire-wrap connector block base, defining a potting well or cavity within which potting material may be deposited.

12 Claims, 3 Drawing Sheets

WIRE-WRAP CONNECTOR BLOCK BASE HAVING AN ARTICULABLE SIDE WALL

FIELD OF THE INVENTION

The present invention relates to wire-wrap terminal blocks and connectors and, more particularly, to a wire-wrap connector base having an articulable side wall.

BACKGROUND OF THE INVENTION

Connector blocks are an essential component of a communications network that provide a simple and reliable way to interconnect the various devices, locations, and people using the network. The connector blocks may be provided as part of telecommunications equipment and may include wire-wrap connectors having a wire-wrap terminal and an insulation-displacement connector (IDC) that facilitates rapid connection of another device to the telecommunications equipment and to the network.

The wire-wrap terminals are typically pre-wired during manufacture of the telecommunications equipment within which the connector block is provided. Once wire-wrapped, the wire-wrap terminals are encased in a protective material, i.e., a potting material. A potting cavity is defined on a bottom of the connector block (where the wire-wrap terminals and wire-wrap connections are located) that may be filled with a potting material. To contain the potting material, the potting cavity is typically defined by a continuous wall that extends about the periphery of the connector block. To facilitate the use of automatic wire-wrap equipment, a wire-wrap terminal must be fully accessible from all directions, i.e., it must not be surrounded by walls. During wire-wrapping, the wire-wrap equipment carries a wire for wrapping and moves both horizontally and vertically with respect to the connector block and wire-wrap terminal. Tolerance is provided for movement in the horizontal direction, but not for movement in the vertical direction. Thus, for a wire-wrap terminal surrounded by walls (the wire-wrap terminals provided at the edges and comers of the connector block), movement of the wire-wrap equipment (and the wire carried thereby) downward over the wire-wrap terminal will cause the wire to break. Consequently, different connector block designs are required (one that includes a potting cavity and facilitates potting, and one that does not) depending upon whether potting is required.

There thus exists a need in the art for a connector block having a base that permits automatic wrapping of wire-wrap terminals and that also provides for application of a potting compound after wire-wrapping is complete.

SUMMARY OF THE INVENTION

The present invention is directed to a wire-wrap connector block base adapted to accept a plurality of wire-wrap connectors. The connector block base includes a bottom surface defining a first plane, and a wall fixedly secured to a peripheral edge of the base at the bottom surface and substantially encircling the bottom surface. The wall extends away from the bottom surface in a direction that is substantially perpendicular to the first plane, and a part of the wall is articulable.

The present invention is also directed to a wire-wrap connector block comprising a base having a bottom surface defining a first plane and a wall secured to a peripheral edge of the base at said bottom surface and substantially encircling the bottom surface. The wall extends away from the bottom surface in a direction that is substantially perpendicular to the first plane, and a part of the wall is articulable. The inventive wire-wrap connector block also includes a wire-wrap connector including a wire-wrap terminal around which a wire may be secured, and an insulation-displacement connector.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWINGS

In the drawing figures, which are not to scale, and which are merely illustrative, and wherein like reference characters denote similar elements throughout the several views.

DETAILED DESCRIPTION OF THE PRESENTLY PREFERRED EMBODIMENTS

The present invention is directed to a wire-wrap connector block having a base that includes an articulable wall section that facilitates both automated wire-wrapping and potting procedures. During the wire-wrap procedure, the articulable wall section is latched in a position that permits the wire-wrap equipment to access the wire-wrap terminals without undesirable vertical movement of the wire-wrap equipment and wire. During the potting procedure, the articulable wall section is latched in a position in which the articulable wall section, together with another, non-articulable wall section, creates a substantially continuous wall about the bottom surface of the wire-wrap connector block base, defining a potting well or cavity within which potting material may be deposited.

Figure 1:
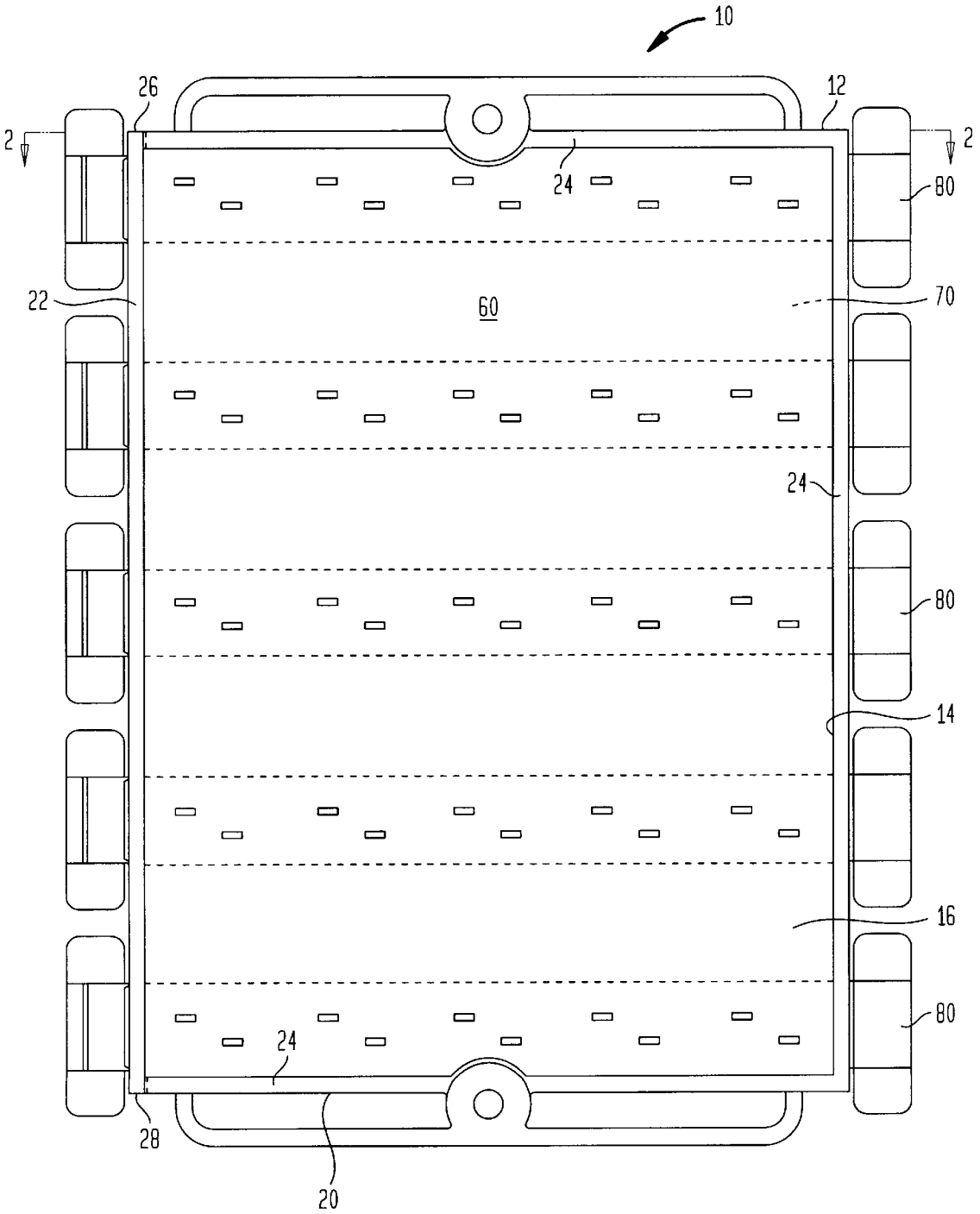
FIG. 1 is a bottom view of a wire-wrap connector block base including an articulable wall section and constructed in accordance with the present invention.

Referring now to the drawings in detail, FIG. 1 is a bottom view of a wire-wrap connector block 10 including a base 12 having a substantially continuous wall 20 comprised of a plurality of wall sections 24 fixedly secured to a peripheral edge 14 of the connector block base 12, and an articulable wall section 22 secured to the peripheral edge 14 by a hinge 30. The articulable wall section 22 is selectively movable between a first position, depicted in FIGS. 1, 4 and 7, in which the wall section 22 extends away from the bottom surface 16 of the connector block base 12 in a direction that is substantially perpendicular to the plane defined by the bottom surface 16. When in the first position, the articulable wall section 22, together with the non-articulable wall sections 24, comprise a substantially continuous wall 20 that substantially encircles the bottom surface 16 and defines a potting cavity 60. Potting material (not shown) may be deposited in the potting cavity 60 (after completion of the wire-wrap procedure, as discussed in more detail below), and is contained therein by the wall 20.

The connector block 10 may also include a plurality of stanchions 80 that extend in a generally vertical direction away from the bottom surface 16. The stanchions 80 serve, in part, as a guide for wires 90 connected to the wire-wrap connectors 40 (see, e.g., FIGS. 2–4). The wires 90 are also guided and held in place by a plurality of troughs 70 that extend widthwise across the connector block base 12 on a side opposite the bottom surface 16.

The connector block 10 also includes a plurality of removable wire-wrap connectors 40 (see, e.g., FIG. 2), each having at least one terminal 46 with a wire-wrap end 42 and an insulation displacement end 44. The wire-wrap end 42 is pre-wired during manufacture of the telecommunications equipment (as discussed in detail below) and provides a connection to the network. The insulation displacement end 44 is wired after the telecommunications equipment is installed (e.g., on a customer premises, in a central office, etc.) and provides a connection between other devices and the network (via the telecommunications equipment.

Referring next to FIGS. 2–4 and 5–7, operation of the articulable wall section 22 will now be discussed in detail. Telecommunications equipment may include a wire-wrap connector block 10 to provide interconnection between the telecommunications network and devices, other equipment, people, etc. using the network. The network-side of the connector block 10 (i.e., that side connected to the wire-wrap terminals 42) is pre-wired during manufacture of the telecommunications equipment. In addition, after the wire-wrapping procedure is completed, a potting compound is typically deposited over the wire-wrap terminals to protect them from exposure to environmental conditions. The articulable wall section 22 of the present invention facilitates both the wire-wrap and potting procedures. During the wire-wrap procedure, the articulable wall section 22 is disposed in the position depicted in FIGS. 2 and 5, and extends away from the bottom surface 16 in a direction substantially coplanar with a plane defined by the bottom surface 16. The articulable wall section 22 may be held in the position depicted in FIGS. 2 and 5 by a retainer 100 comprised of complementary fasteners such as, for example, a ball 104 and socket 102. The retainer 100 is preferably provided at longitudinal ends 26, 28 (see, e.g., FIG. 1) of the articulable wall section 22. The particular embodiment of the retainer 100 depicted in the figures and discussed herein is provided merely as an illustrative, non-limiting example, it being recognized that any retainer comprised of complementary interlocking parts will provide the desired functionality.

Figure 2:
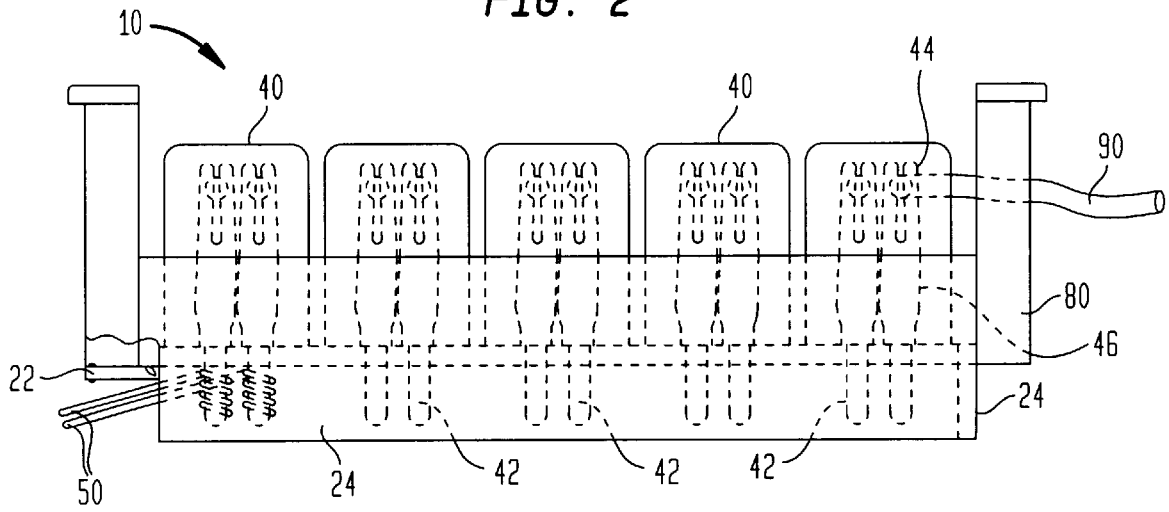
FIGS. 2–4 are side views taken along the line 2—2 of FIG. 1 and depicting an articulable wall section of a wire-wrap connector block base in various positions and constructed in accordance with the present invention.
Figure 3:
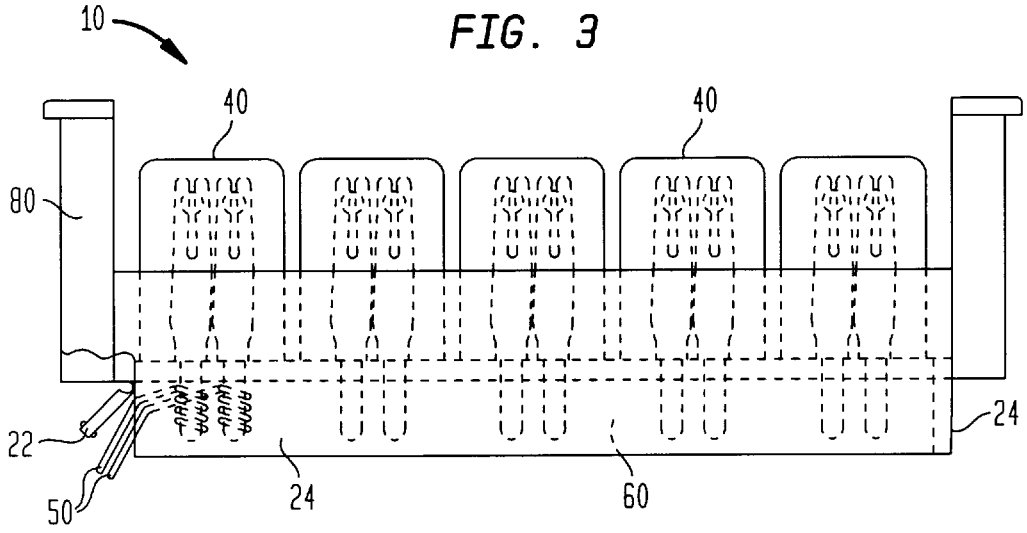
Figure 5:
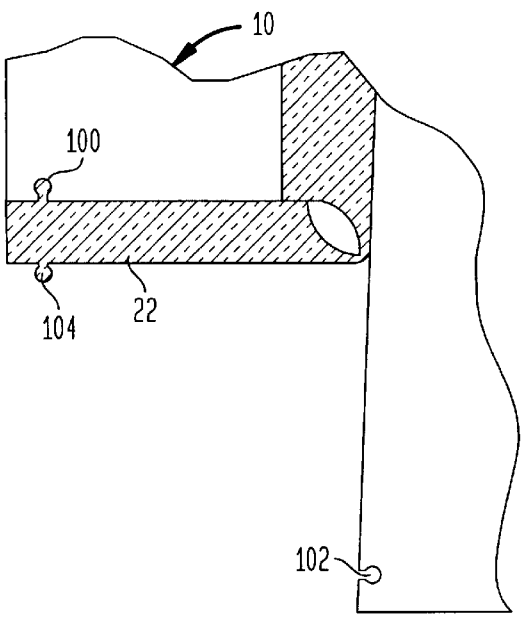

With the articulable wall section 22 disposed as depicted in FIGS. 2 and 5, automated wire-wrap equipment (not shown) may be used to wrap a wire 50 about each wire-wrap terminal 42. As can be seen in FIG. 2, the wire 50 may be wrapped about the terminal 42 without bending or otherwise deflecting the wire 50 in the vertical direction (in the figure) (i.e., in a direction coaxial with the terminal 42); such movement typically imparting stress to the wire and leading to breakage of the wire. Thus, advantageous movement of the wire-wrap equipment only in a substantially horizontal direction is possible and the undesirable vertical movement, bending, deflection, etc. of the wire 50 is avoided.

Figure 4:
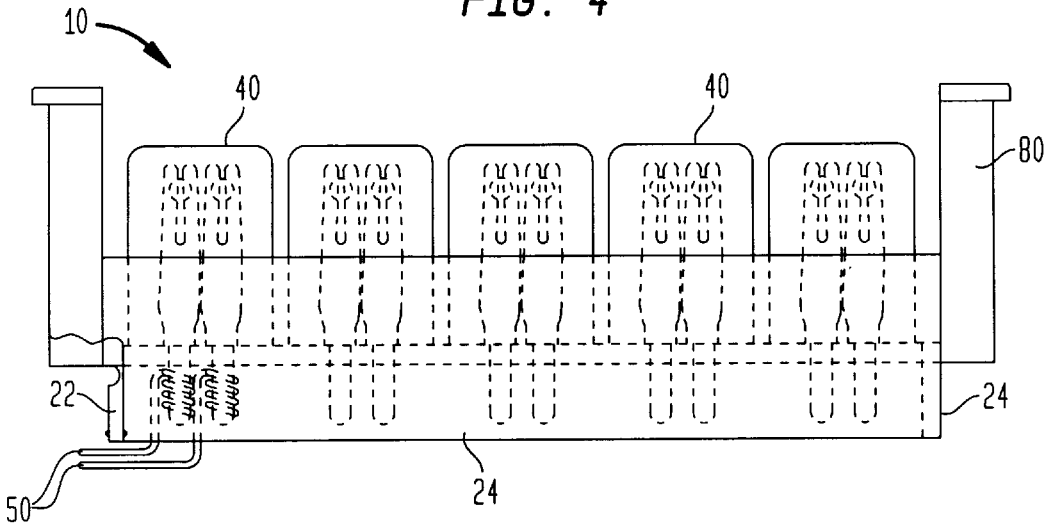
Figure 7:
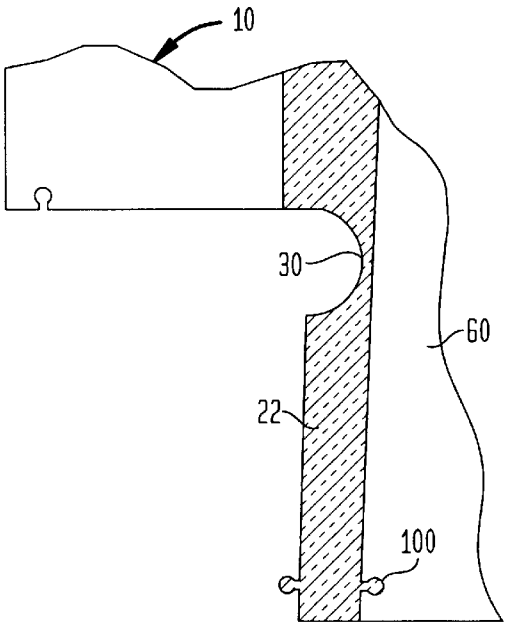
FIGS. 5–7 are exploded, partial cross-sectional views of the articulable wall section of a wire-wrap connector block base constructed in accordance with the present invention.
Figure 6:
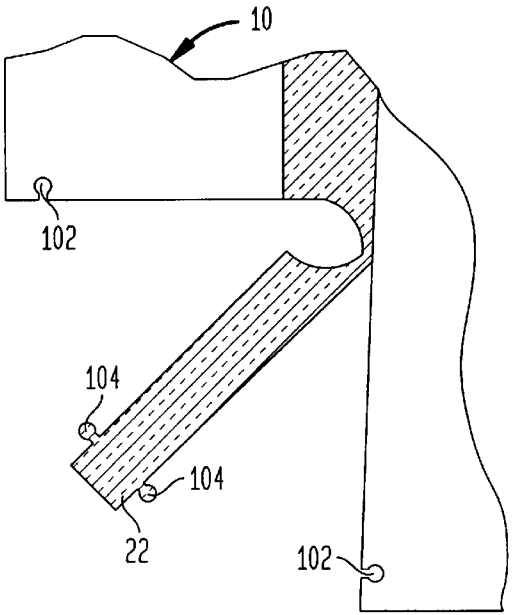

Once the wire-wrap procedure is complete, the articulable wall section 22 may be selectively moved out of the position depicted in FIGS. 2 and 5, and into the positions depicted in FIGS. 3–4 and 6–7. A hinge 30 (see, e.g. FIG. 7) facilitates selective movement of the articulable wall section 22. When the articulable wall section 22 is in the position depicted in FIGS. 3 and 6, the wire 50 previously wrapped about the wire-wrap terminal 42 may be bent or deflected in a substantially vertical direction because it is no longer tethered or connected to the wire-wrap equipment. The wire 50 can be bent without imparting undue stress on the wire 50 until the articulable wall section 22 is positioned as depicted in FIGS. 4 and 7. A retainer 100 is also provided to hold the articulable wall section 22 in the position depicted in FIGS. 4 and 7 and is comprised of complementary ball 104 and socket 102 fasteners. The connector block 10 may now be subjected to a potting procedure during which a potting material is deposited about the wire-wrap terminals to protect the terminals and the wired wound thereabout. The articulable wall section 22, together with the non-articulable wall sections 24 make up a substantially continuous wall 20 that encircles the wire-wrap terminals 42 and defines a potting cavity 60 in an area adjacent the bottom surface 16 of the connector block base 12.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A connector block base comprising:

a bottom surface defining a first plane and having features formed therethrough for receiving terminal strips; and a wall extending from a peripheral edge of said base at said bottom surface and substantially encircling said bottom surface to define a cavity proximate said bottom surface, said wall having a section articulable between a first position wherein said cavity is enclosed by said wall and a second position wherein said cavity is accessible through a space occupied by said wall section when said wall section is in said first position.

2. A connector block base as recited by claim 1, wherein when in said first position, said articulable wall section extends away from said bottom surface in a direction that is substantially perpendicular to said first plane.

3. A connector block base as recited by claim 1, wherein said connector block base further comprises a retainer for holding said articulable wall section in said first position.

4. A connector block base as recited by claim 1, wherein when in said second position, said articulable wall section extends away from said bottom surface in a direction that is substantially coplanar with said first plane.

5. A connector block base as recited by claim 1, wherein said connector block base further comprises a retainer for holding said articulable wall section in said second position.

6. A connector block base as recited by claim 1, further comprising a hinge adapted to facilitate selective movement of said articulable wall section between said first and said second positions.

7. A connector block comprising:

a base having a bottom surface defining a first plane and having a feature formed therethrough; and a wall extending from a peripheral edge of said base at said bottom surface and substantially encircling said bottom surface to define a cavity proximate said bottom surface, said wall having a section articulable between a first position wherein said cavity is enclosed by said wall and a second position wherein said cavity is accessible through a space occupied by said wall section when in said first position; and a terminal strip including a wire-wrap terminal extending through said feature.

8. A connector block as recited by claim 7, wherein when in said first position, said articulable wall section extends away from said bottom surface in a direction that is substantially perpendicular to said first plane.

9. A connector block as recited by claim 7, wherein said base further comprises a retainer for holding said articulable wall section in said first position.

10. A connector block as recited by claim 7, wherein when in said second position said articulable wall section extends away from said bottom surface in a direction that is substantially coplanar with said first plane.

11. A connector block as recited by claim 7, wherein said base further comprises a retainer for holding said articulable wall section in said second position.

12. A connector block as recited by claim 7, further comprising a hinge adapted to facilitate selective movement of said articulable wall section between said first and said second positions.

* * * * *